US007174841B2

(12) United States Patent
Lindholm et al.

(10) Patent No.: US 7,174,841 B2
(45) Date of Patent: Feb. 13, 2007

(54) METHOD AND AN ARRANGEMENT FOR REDUCING THE WEIGHT AND OPTIMIZING THE LONGITUDINAL STRENGTH OF A WATER-CRAFT

(75) Inventors: Mauri Lindholm, Turku (FI); Aarno Perkiö, Piispanristi (FI); Juhani Siren, Raisio (FI)

(73) Assignee: Aker Yards Oy, Turku (FI)

( * ) Notice: Subject to any disclaimer, the term of this patent is extended or adjusted under 35 U.S.C. 154(b) by 107 days.

(21) Appl. No.: 10/508,389

(22) PCT Filed: Mar. 28, 2003

(86) PCT No.: PCT/FI03/00239

§ 371 (c)(1),
(2), (4) Date: Sep. 20, 2004

(87) PCT Pub. No.: WO03/082665

PCT Pub. Date: Oct. 9, 2003

(65) Prior Publication Data

US 2005/0166817 A1 Aug. 4, 2005

(30) Foreign Application Priority Data

Mar. 28, 2002 (FI) ..... 20020616

(51) Int. Cl.
*B63B 25/14* (2006.01)
*B63B 25/16* (2006.01)

(52) U.S. Cl. ..... 114/74 A; 220/560.11

(58) Field of Classification Search ..... 114/74 R, 114/74 A; 220/901, 560.11
See application file for complete search history.

(56) References Cited

U.S. PATENT DOCUMENTS 3,087,454 A 4/1963 Lorentzen
3,968,764 A * 7/1976 Kvamsdal et al. ..... 114/74 A
4,382,524 A * 5/1983 Kvamsdal ..... 220/560.09

FOREIGN PATENT DOCUMENTS

| | | |
|---|---|---|
| EP | 0 453 617 | 10/1991 |
| GB | 786720 | 11/1957 |
| JP | 52-51688 | 4/1977 |
| WO | 98/56651 | 12/1998 |

* cited by examiner

*Primary Examiner*—Sherman Basinger
(74) *Attorney, Agent, or Firm*—Smith-Hill and Bedell

(57) ABSTRACT

A method and arrangement for reducing the weight and optimizing the longitudinal strength of a watercraft, which is especially suitable for transportation of liquefied natural gas (LNG) or other corresponding mediums and comprises a hull, which has a deck extending over at least the main part of the watercraft and a number of substantially spherical cargo tanks arranged successively in the longitudinal direction of the watercraft and a deckhouse, which extends substantially above the deck. The hull of the watercraft is provided with a continuous protective casing structure known as such and which is arranged on top of the cargo tanks. The deck of the watercraft is arranged on the hull so that the proportion of its height measured from the bottom of the watercraft to the height of the uppermost continuous portion of the protective casing structure on top of the cargo tanks is at most 0.55, preferably at most 0.5. In addition, the protective casing structure is fixed to the deck and/or other structures supported to the hull and is dimensioned together with the other parts of the hull so that together they constitute an essential part of the overall strength of the watercraft.

24 Claims, 4 Drawing Sheets

Figure 1A:
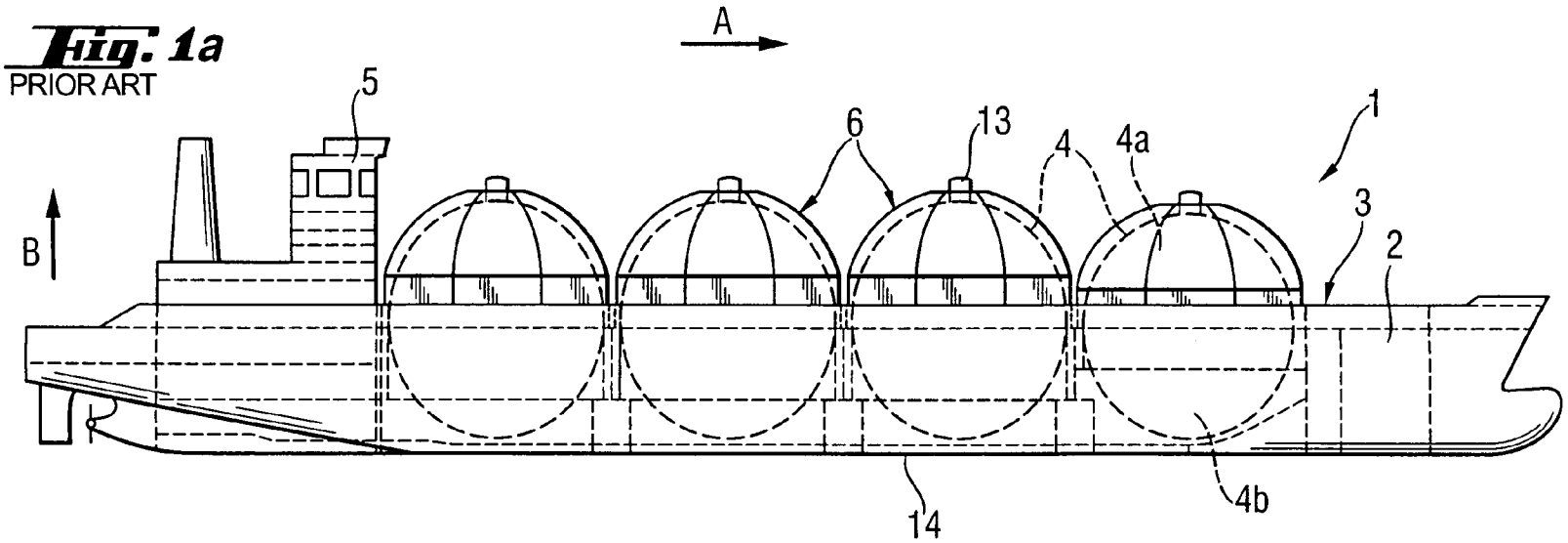
Fig. 1a PRIOR ART

METHOD AND AN ARRANGEMENT FOR REDUCING THE WEIGHT AND OPTIMIZING THE LONGITUDINAL STRENGTH OF A WATER-CRAFT

This is a national stage application filed under 35 USC 371 based on International Application No. PCT/FI2003/00239 filed Mar. 28, 2003, and claims priority under 35 USC 119 of Finnish Patent Application No. 20020616 filed Mar. 28, 2002.

The invention relates to a watercraft suitable for transportation of fluid material at low temperature.

The hull of the water-craft is long and it is exposed to stresses of various kinds, such as twisting and bending, which are set up by the forces exerted on the hull, such as its own weight, the cargo, the buoyant force of water, wave action, splashes caused by the swell of sea, and the movements of the water-craft at sea. Thus the water-craft hull resembles a long beam, which must have certain strength properties all along, because it has a tendency to bend, fracture and twist. So, the hull has to tolerate the bending moment, twisting and so-called shear forces it is subjected to, in other words the longitudinal strength is the most essential strength property of the water-craft's hull. The requirements of the longitudinal strength are at their highest in the middle part of the water-craft, as the hull of the water-craft is elongate and the waves bend it. Therefore a sectional view of the water-craft's so-called mid-ship is often illustrated showing the hull elements which contribute to the longitudinal strength, i.e. all the continuous parts of the hull in the longitudinal direction, such as decks, boards, bottom and longitudinal bulkheads, of which the latter stand for all longitudinal vertical parts of the water-craft except for the boards.

Previously it has been suggested to protect cargo tanks with a separate protective casing structure, which in most cases is also spherical. Such structures are disclosed e.g. in U.S. Pat. No. 2,048,312 describing the loading and unloading of spherical tanks, and in U.S. Pat. No. 5,697,312, according to which a lower cargo tank is preferably disposed in front of a higher one. A protective casing for a continuous tank is disclosed in GB Patent No. 829,205 and in U.S. Pat. No. 1,284,689, and protective casing structures for separate tanks in GB Patent No. 784,390 and in U.S. Pat. No. 3,087,454.

Significant disadvantages are associated with the prior art. In all the aforementioned cases the protective casing structure provides merely a protective casing for individual tanks, i.e. it is more or less a weather guard, and not a part of the strength element of the water-craft's hull. The material of the water-craft's hull near the protective casings has to be for instance high-strength steel, because the above-described structures require very high material thicknesses. In known arrangements the longitudinal strength of the water-craft for the part above the hull is only based on the narrow upper deck, whereby it has to be constructed at a relatively high position and for its upper parts it together with the surrounding structures has to be of very thick material in order to provide sufficient strength. This increases the weight of the water-craft and also limits the size of the tanks, and in the worst case even restricts the number of tanks.

The publication JP A 52-51688 discloses a protective casing structure which extends over spherical tanks and the purpose of which is also to improve the longitudinal strength of a water-craft. The improvement of the longitudinal strength is however essentially related to adding material to the protective casing structure at the sides of the openings at the position of the spherical tanks on the deck of the water-craft, which strengthens the deck at the very position of the tanks. The solution is disadvantageous from the viewpoint of manufacturing technique and increases essentially the weight of the water-craft.

Spherical tanks or cargo containers refer in this connection to ones including substantially semispherical upper and lower parts, the inner radii corresponding at least roughly to each other. In addition between these parts there can be a cylindrical elevation part or a so called stretched equator part such as is disclosed for instance in the publication EP 742139.

An aim of the present invention is to eliminate the disadvantages of the prior art and to provide a new kind of solution, which makes it possible to decrease the weight and improve and optimize the longitudinal strength of a water-craft.

In accordance with the invention the hull of the water-craft is provided with a continuous protective casing structure known as such and which is arranged on top of the cargo tanks. The said deck of the water-craft is arranged on the hull so that the proportion of the height of it or the actual hull part measured from the bottom of the water-craft to the height of the uppermost continuous portion of the protective casing structure on top of the cargo tanks is at most 0.55, preferably at most 0.5. In addition said protective casing structure is fixed to said deck and/or other structures supported to the hull and is dimensioned together with the other parts of the hull so that together they constitute an essential part of the overall strength of the water-craft strengthening the hull.

Thus according to the solution of the invention the continuous protective casing structure and the lowered hull together actively participate in providing longitudinal strength of the entire water-craft, which enables more advantageous distribution of the material of the water-craft and, thus, savings in weight, which can be in the order of 10% of the so called own weight or light weight of the water-craft in comparison with a conventional ship with spherical tanks having corresponding displacement. Consequently a water-craft provided with the arrangement according to the invention can take more cargo correspondingly without a change in the displacement. Hereby the economic efficiency in using the water-craft can essentially be affected by means of the invention.

In the arrangement according to the invention the continuous protective casing structure extends in the longitudinal direction of the hull at least substantially over the cargo tanks and is at its both ends fixed to the deck of the water-craft and/or to other structures supported to the hull. Generally, when a structure subject to stresses is attached to another structure, the latter structure has to be locally rigid enough in order to distribute the tensions transmitted via the former structure in a controlled manner to the rest of the construction. In this case the protective casing is at the sides thereof advantageously attached to the deck of the water-craft, more precisely to a spot where a continuous longitudinal bulkhead is located underneath the deck. Similarly, the ends of the protective casing are attached to the actual hull part, main deck or upper deck to a spot where a transverse bulkhead is located underneath the deck.

According to the invention said protective casing structure may at its one end with advantage be fixed to the deckhouse of the water-craft. The deckhouse refers for instance to accommodation rooms, to the bridge of the water-craft or the like. The protective casing structure may thus extend entirely over the cargo tanks, and the deckhouse may be located anywhere on the water-craft, that is no matter whether at the bow or at the stern of the water-craft.

In order that the lowered hull part or board of the water-craft would not have a disadvantageous effect on the seaworthiness of the water-craft, an elevation part can be arranged on said hull and/or deck at the forepart of the water-craft in front of the cargo tanks. In this case the protective casing structure can with advantage be fixed to said elevated deck part. In case the deckhouse is located at the bow of the water-craft the protective casing structure can naturally be fixed at its front part to the deckhouse.

The protective casing structure can further with advantage be arranged to be connected to the deckhouse by means of supporting beams. When suitably dimensioned the supporting beams can then serve also as strengthening parts, but in practice they generally serve substantially as a passage between the protective casing structure and the deckhouse.

The top portion of the tanks, the so-called dome, protrudes through the protective casing, but it is not in metallic contact with the casing, but instead connected to it for instance via a tight rubber seal. The connection between the protective casing and the dome has to be tight and flexible, as both the tanks and the protective casing will shrink, stretch or bend in different ways in relation to each other, and not necessarily simultaneously.

The cargo tanks of the water-craft are at their bottom portions fixed to the lower part of the water-craft's hull. Thus the tanks are not fixed to the protective casing structure, but located at a distance from it, as is described above. The fixing itself does not differ from prior art arrangements and therefore the details thereof are not described herein. The tanks are fixed only by means of the cylindrical structure of the lower part of the hull, in other words the tanks are self-supporting or independent separate structures so they must not be exposed to any significant stress due to the deformations of the water-craft's hull.

The intermediate space between the protective casing structure of the water-craft and the cargo tanks is filled with medium, physical properties of which, for instance pressure, composition, humidity and/or temperature, are arranged to be controlled according to need and which is advantageously dry air or protective gas. Thus the space between the protective casing and the cargo tanks, i.e. the so-called cargo hold, is a tight-proof space, where a so-called controlled atmosphere prevails, in other words the air pressure, air humidity and the like may be predetermined and adjusted, if necessary.

The protective casing structure may be dimensioned so that it is in the vertical-direction of the water-craft lower than said deckhouse. If the deckhouse, e.g. the living quarters, is located at the stern of the vessel, it is necessary to have an unhampered line of sight over the protective casing structure from the bridge preferably located above the deckhouse. Similarly, if the deckhouse is located at the bow of the water-craft, it may be lower, as no visual obstruction forwards exists.

The protective casing structure of the water-craft supports with advantage the piping and electric cables leading to the cargo tanks, whereby it is not necessary to design any other generally complicated frameworks to support the pipeline. The protective casing structure also provides access to the vicinity of the domes of the cargo tanks, whereby the supervision of the tanks is facilitated.

Figure 1B:
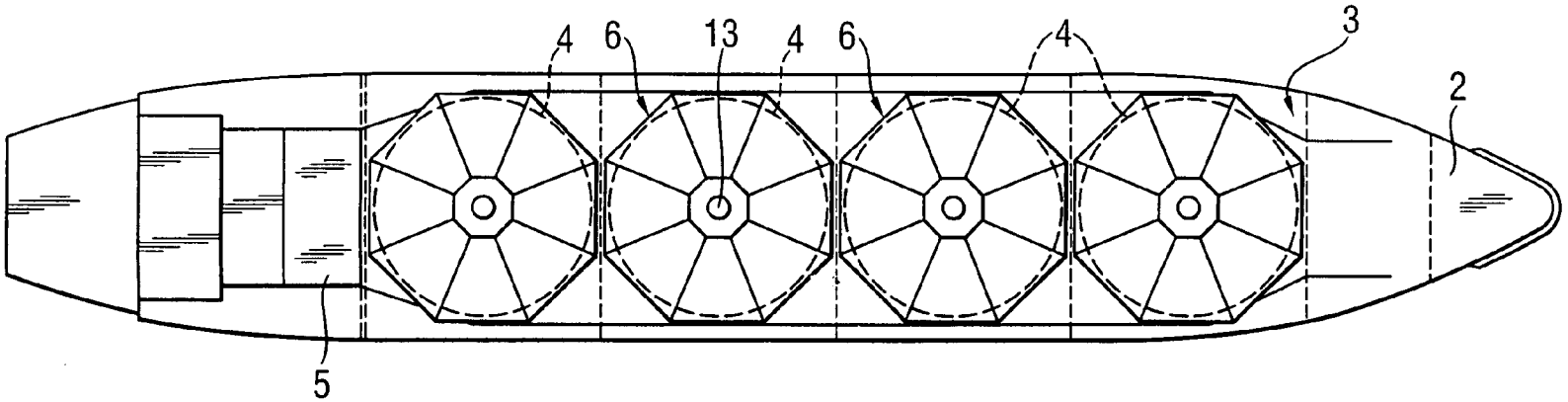
Fig. 1b PRIOR ART
Figure 2A:
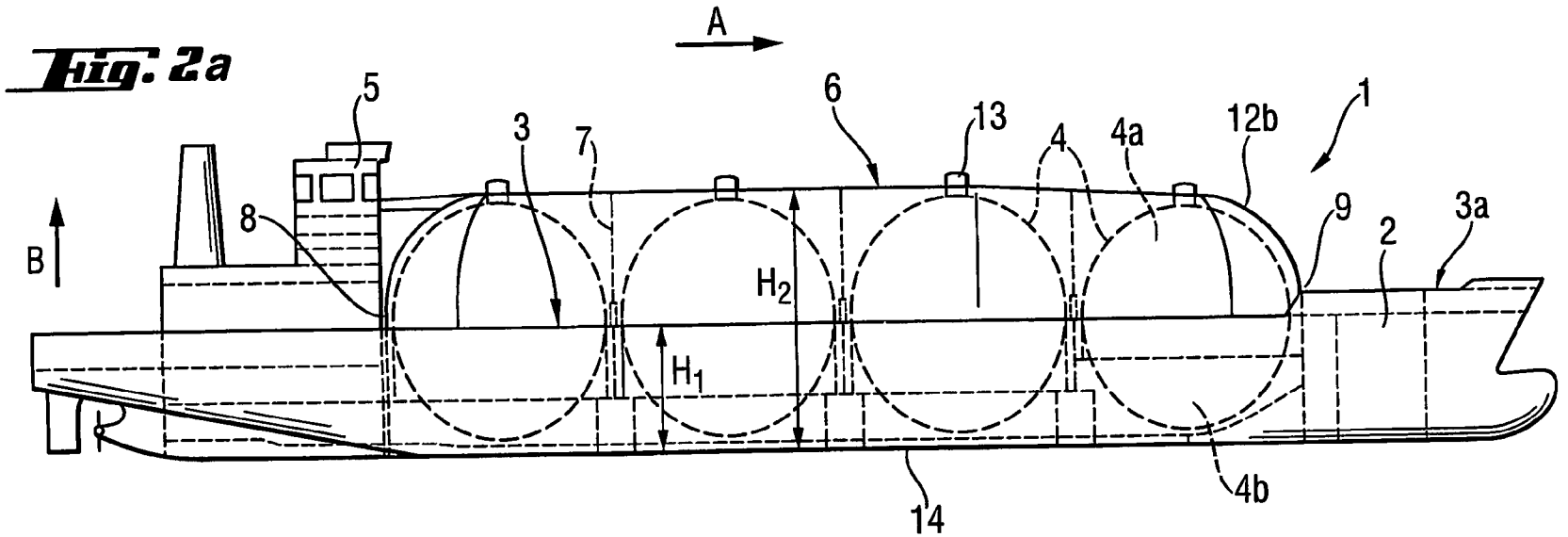
Figure 2B:
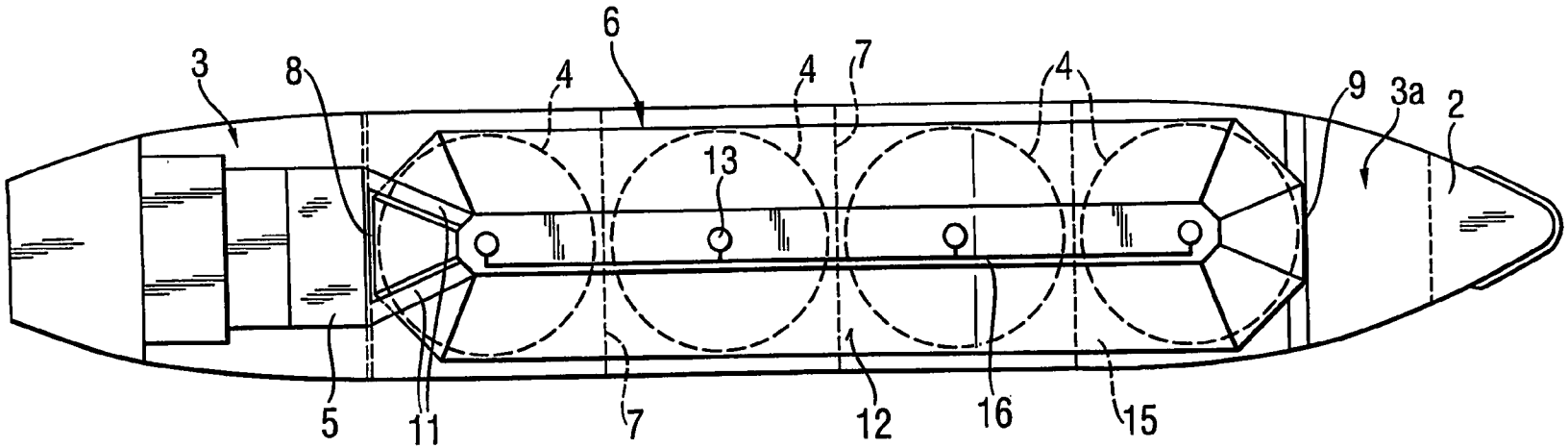
Figures 3A, 3B:
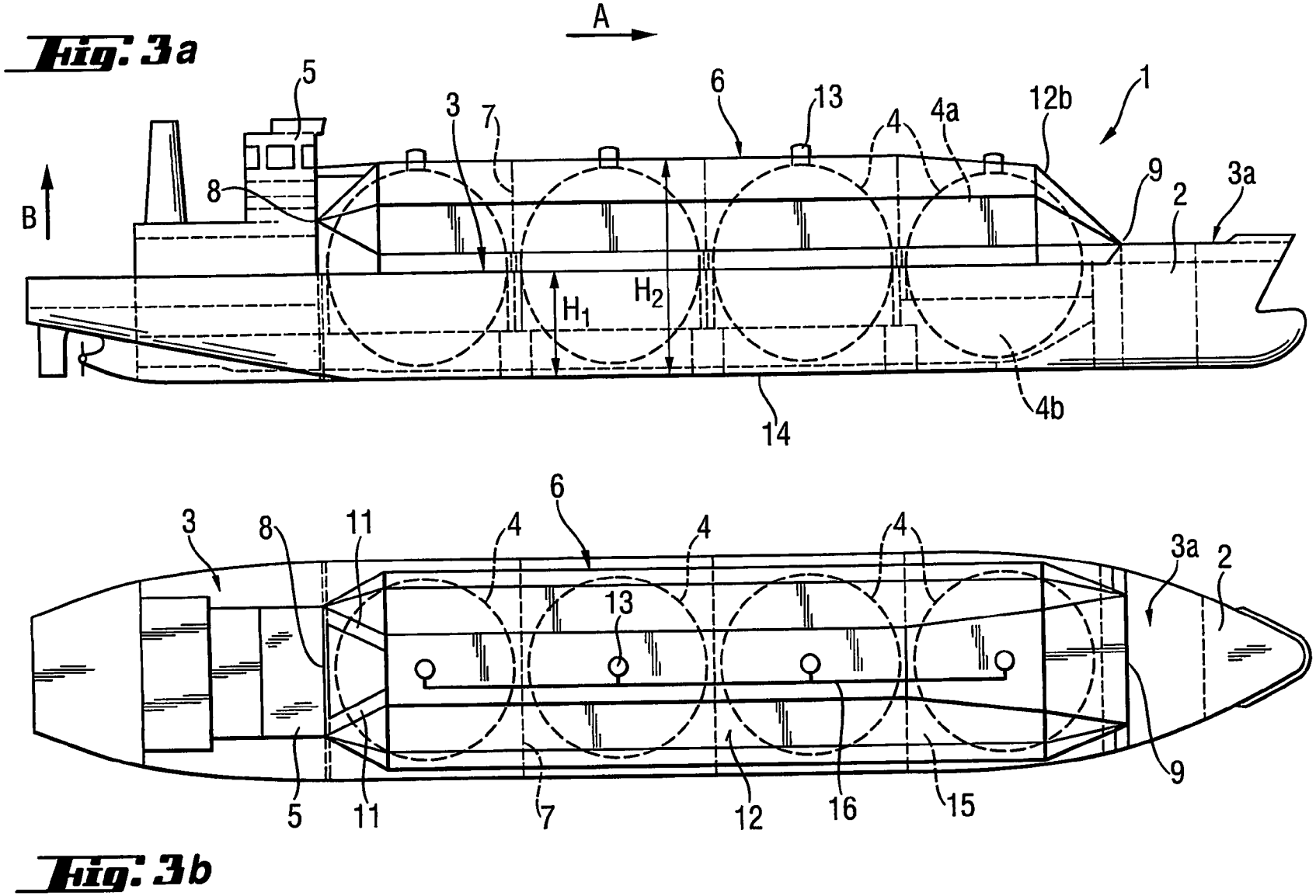
Figure 4B:
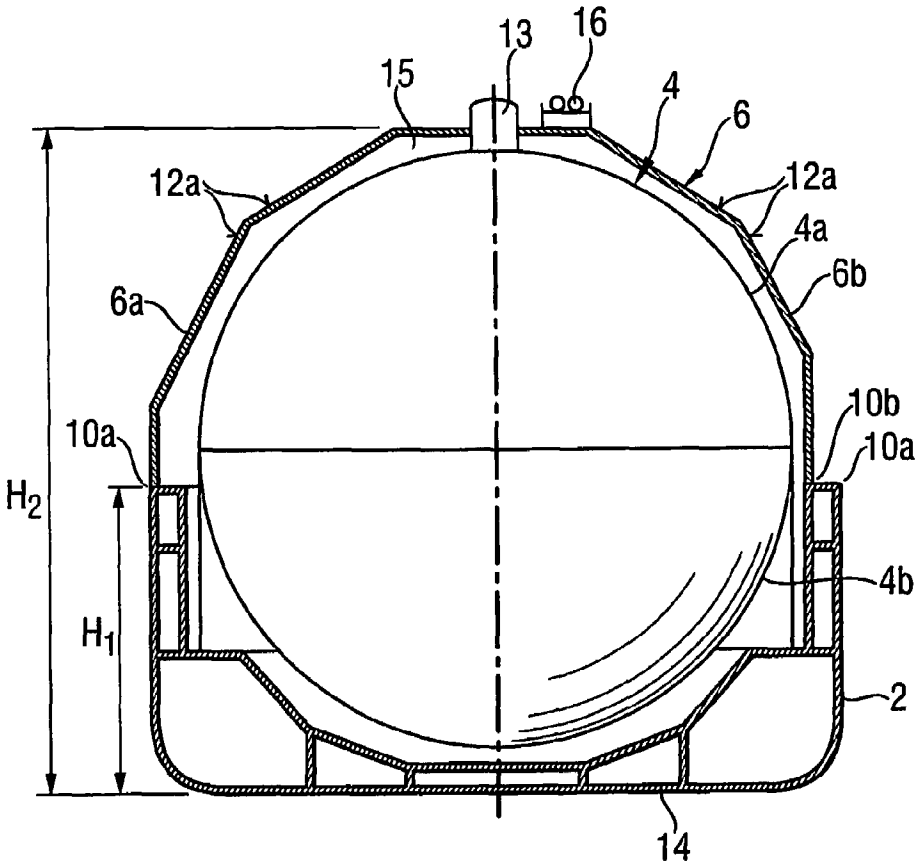
Figure 4A:
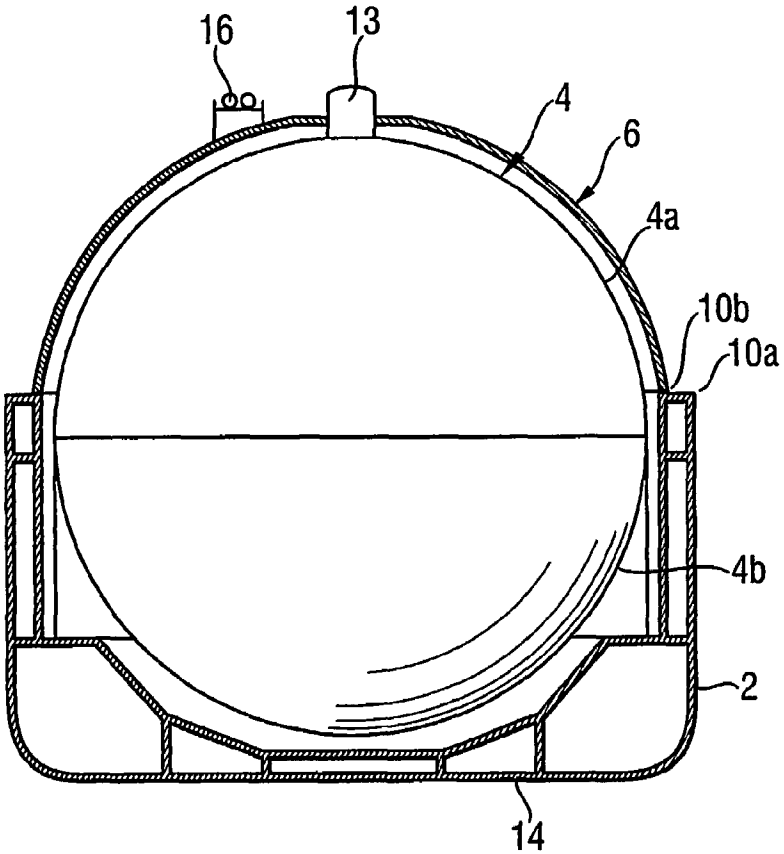

In the following the invention is described by way of example with reference to the attached drawings, in which FIGS. 1*a* and 1*b* show a prior art arrangement as a side view in the upper figure and viewed from above in the figure below, FIGS. 2*a* and 2*b* show a protective casing structure according to the invention as a side view in the upper figure and viewed from above in the figure below, FIGS. 3*a* and 3*b* show an alternative protective casing structure according to the invention as a side view in the upper figure and viewed from above in the figure below, and FIGS. 4*a* and 4*b* show side by side sectional views of a prior art arrangement in FIG. 4*a* and an arrangement according to the invention in FIG. 4*b*.

In FIGS. 1*a* and 1*b* the reference number 1 indicates a water-craft. The figure shows also a hull 2 and a deck 3 of the water-craft as well as cargo tanks 4, each of which is covered by a protective casing structure 6. In addition, a deckhouse 5 is illustrated, in this case located at the stern of the water-craft 1. The upper part of the cargo tanks includes an extension part 13, to which all the pipe assemblies of the cargo tank are arranged (not shown more precisely). The lower part of the hull is 14.

FIGS. 2*a* and 2*b* show an advantageous embodiment of an arrangement according to the invention, where above a hull 2 and a deck 3 of a water-craft is arranged a continuous protective casing structure 6, which provides an overall cover for spherical cargo tanks 4, which are formed of semispherical elements 4*a* and 4*b*. In addition, the figure shows a deckhouse 5 located at the stern of the water-craft 1, from which deckhouse there is an unhampered line of sight in the direction of travel or in the longitudinal direction A of the water-craft over the protective casing structure 6 and extension parts 13 protruding through it. Supporting structures 7 underneath the protective casing structure 6, fixing points of the cargo tanks in the hull's lower part 14 and piping 16 leading to the cargo tanks are also illustrated.

In accordance with the invention the deck 3 of the water-craft is located essentially lower than conventionally so that the proportion of the height H1 of it or the actual hull part to the height of the uppermost continuous portion of the protective casing structure is at most 0.55, preferably at most 0.5. In order to secure the seaworthiness of the water-craft the forepart of the deck 3 includes an elevation part 3*a*. In this embodiment the curved protective casing structure 6 is fixed at its rear end 8 to the deck 3 and at its front end 9 to the elevation part 3*a* in the deck 3. The figures also shows supporting beams 11, a protection structure 12, which is formed of curved surfaces 12*b*, an intermediate space 15 between the cargo tanks 4 as well as the vertical direction B of the water-craft 1.

FIGS. 3*a* and 3*b* show an alternative embodiment, where above a hull 2 and a deck 3 of a water-craft is arranged a protective casing structure 6 formed of planar members and which in this case is at the bow of the water-craft 1 fixed to the elevation part 3*a* of the deck 3 at point 9, and to the deckhouse 5 at its rear end 8. The support structures 7 underneath the protective casing structure 6, fixing points of the cargo tanks in the hull's lower part 14, and pipelines and electric cables 16 leading to the cargo tanks are also illustrated as well as supporting beams 11 for a protection structure 12 and an intermediate space 15 between the cargo tanks 4. The cargo tanks 4 are also in this case formed of semispherical elements 4*a* and 4*b* attached to the lower part 14 of the water-craft's 1 hull 2 in a manner known per se.

FIGS. 4*a* and 4*b* show side by side a prior art arrangement (FIG. 4*a*) and an arrangement according to the invention (FIG. 4*b*), whereby the height difference between the outboards of the water-craft in these two structures becomes apparent. In the figures the cargo tanks 4 are covered by a protective casing structure 6, whereby the protective casing according to the invention in FIG. 4*b* is formed of planar surfaces 12*a*, which form a continuation 6*a* of the outboard 10*a* or alternatively a continuation 6*b* of the inboard 10*b* of the water-craft. When necessary the protective casing structure 6 may be provided with bulkheads extending in the longitudinal direction of the water-craft for ensuring sufficient strength.

It is apparent to a person skilled in the art that the invention is not limited to the embodiments described above which are only examples for applying the invention, but various modifications of the invention are feasible within the scope of the attached claims.

The invention claimed is:

1. A watercraft suitable for transportation of liquefied natural gas (LNG), said watercraft comprising:

an elongate hull having a bottom, a deck extending over a substantial part of the length of the hull at a height above the bottom of the hull that does not exceed H1, a plurality of substantially spherical cargo tanks located in the hull at respective positions that are spaced apart longitudinally of the hull, said cargo tanks comprising an aft tank, at least first and second additional tanks forward of the aft tank, and a forward tank located forward of said first and second additional tanks, and a continuous protective casing structure that extends over the cargo tanks and has an uppermost continuous portion at a substantially uniform height H2 above the bottom of the hull, and wherein the protective casing structure is fixed to structures that are attached to the hull and is dimensioned so that it constitutes an essential part of the overall strength of the watercraft, H1 is at most 0.55 times H2, the second additional tank is forward of the first additional tank, the second additional tank and the forward tank each have a top portion, the top portion of the forward tank is lower than the top portion of the second additional tank, and the uppermost continuous portion is of substantially uniform height between the aft tank and the second additional tank and decreases in height between the second additional tank and the forward tank.

2. A watercraft according to claim 1, further comprising a deckhouse that extends upwards from the deck and wherein the casing structure is fixed to the deckhouse.

3. A watercraft according to claim 2, wherein the protective casing structure extends in the longitudinal direction of the hull at least substantially over the cargo tanks and is fixed at one end to the deckhouse.

4. A watercraft according to claim 2, comprising beams attaching the protective casing structure to the deckhouse.

5. A watercraft according to claim 1, wherein at least one of the cargo tanks has an extension part that extends upwards from a top region of the tank and extends through the protective casing structure.

6. A watercraft according to claim 1, wherein an intermediate space is defined between the cargo tanks and the protective casing structure and the intermediate space is filled with a medium.

7. A watercraft according to claim 1, comprising piping and electric cables leading to the cargo tanks and wherein the protective casing structure supports said piping and electric cables.

8. A watercraft according to claim 1, comprising a deckhouse that extends upwards from the deck in an aft region of the watercraft to a height above the protective casing structure.

9. A watercraft according to claim 8, comprising an elevation part forward of the cargo tanks and wherein the protective casing structure is fixed to the deckhouse and to the elevation part of the watercraft.

10. A watercraft according to claim 9, wherein the elevation part is part of the hull.

11. A watercraft according to claim 9, wherein the elevation part is part of the deck.

12. A watercraft according to claim 1, wherein the protective casing structure is formed of planar members.

13. A watercraft suitable for transportation of liquefied natural gas (LNG), said watercraft comprising:

an elongate hull having a bottom, a deck extending over a substantial part of the length of the hull at a height above the bottom of the hull that does not exceed H1, a plurality of substantially spherical cargo tanks located in the hull at respective positions that are spaced apart longitudinally of the hull, said cargo tanks comprising an aft tank, an intermediate tank forward of the aft tank, and a forward tank located immediately forward of said intermediate tank, and a continuous protective casing structure that extends over the cargo tanks and has an uppermost continuous portion at a substantially uniform height H2 above the bottom of the hull, and wherein the protective casing structure is fixed to structures that are attached to the hull and is dimensioned so that it constitutes an essential part of the overall strength of the watercraft, H1 is at most 0.55 times H2, the uppermost continuous portion is of substantially uniform height between the aft tank and the intermediate tank, the intermediate tank and the forward tank each have a top portion, the top portion of the forward tank is lower than the top portion of the intermediate tank, and the uppermost continuous portion decreases in height between the intermediate tank and the forward tank.

14. A watercraft according to claim 13, further comprising a deckhouse that extends upwards from the deck and wherein the casing structure is fixed to the deckhouse.

15. A watercraft according to claim 14, wherein the protective casing structure extends in the longitudinal direction of the hull at least substantially over the cargo tanks and is fixed at one end to the deckhouse.

16. A watercraft according to claim 14, comprising beams attaching the protective casing structure to the deckhouse.

17. A watercraft according to claim 13, wherein at least one of the cargo tanks has an extension part that extends upwards from a top region of the tank and extends through the protective casing structure.

18. A watercraft according to claim 13, wherein an intermediate space is defined between the cargo tanks and the protective casing structure and the intermediate space is filled with a medium.

19. A watercraft according to claim 13, comprising piping and electric cables leading to the cargo tanks and wherein the protective casing structure supports said piping and electric cables.

20. A watercraft according to claim 13, comprising a deckhouse that extends upwards from the deck in an aft region of the watercraft to a height above the protective casing structure.

21. A watercraft according to claim 20, comprising an elevation part forward of the cargo tanks and wherein the protective casing structure is fixed to the deckhouse and to the elevation part of the watercraft.

22. A watercraft according to claim 21, wherein the elevation part is part of the hull.

23. A watercraft according to claim 21, wherein the elevation part is part of the deck.

24. A watercraft according to claim 13, wherein the protective casing structure is formed of planar members.

* * * * *